US006119354A

United States Patent [19]

Hansen

[11] Patent Number: 6,119,354

[45] Date of Patent: Sep. 19, 2000

[54] TRAMMEL ADAPTOR FOR A SQUARE HEAD

[76] Inventor: Owen Hansen, 400 Greenfield Dr. #74, El Cajon, Calif. 92021

[21] Appl. No.: 09/251,795

[22] Filed: Feb. 12, 1999

[51] Int. Cl.[7] ..... B43L 9/04

[52] U.S. Cl. ..... 33/27.03; 33/427

[58] Field of Search ..... 33/27.03, 27.031, 33/27.032, 27.033, 418, 419, 427, 428, 474, 480

[56] References Cited

U.S. PATENT DOCUMENTS

| | | | |
|---|---|---|---|
| 673,687 | 5/1901 | Penfield | 33/27.03 |
| 2,246,066 | 6/1941 | Rothe | 33/427 |
| 2,440,973 | 5/1948 | Podolan | 33/27.033 |
| 2,499,673 | 3/1950 | Olejniczak | 33/27.031 |
| 2,645,022 | 7/1953 | Hart | 33/27.033 |
| 2,797,491 | 7/1957 | Asperger | 33/427 |
| 3,089,245 | 5/1963 | Cromer et al. | 33/27.03 |
| 4,380,872 | 4/1983 | Moran | 33/427 |

FOREIGN PATENT DOCUMENTS

| | | | |
|---|---|---|---|
| 1276057 | 10/1961 | France | 33/27.03 |

*Primary Examiner*—G. Bradley Bennett
*Attorney, Agent, or Firm*—Charles C. Logan, II

[57] ABSTRACT

A trammel adaptor for a square head. It has a right angle bracket having a vertical leg and a horizontal leg. A vertically extending left flange is connected to the left edge of the vertical leg and they intersect each other at an acute angle A. A vertically extending right flange is connected to the right edge of the vertical leg and they intersect each other at an acute angle B. The planar inner surface and the respective left and right flanges form a tract for removably receiving the vertical flanges of a square head. An elongated indicator leg is vertically mounted on the bottom of the right angle bracket. The pointed bottom end of the indicator leg may have its height adjusted vertically along a Y-axis that also passes along the vertical rear surface of the square head.

7 Claims, 1 Drawing Sheet

TRAMMEL ADAPTOR FOR A SQUARE HEAD

BACKGROUND OF THE INVENTION

The invention relates to trammel-and-beam instruments and it is concerned with beam compasses (also known as rules) of the type including a compass beam and one or more removable trammels. More specifically, the invention relates to an adaptor that can be removably secured on a square head to provide the square head with structure that allows it to function as a trammel.

Trammels have been known or existed for many years. The Christian U.S. Pat. No. 314,316 discloses a draftsman's tool having a rule which is marked on its face with a scale in inches or centimeters and fractions thereof, or any other scale. Two slides are mounted on the rule and they may be adjusted longitudinally. Each slide supports structure holding a needlepoint or a pencil.

The Jooss U.S. Pat. No. 1,321,312 is directed to a combination tool having a machinist blade or ruler and a fixture mounted on one edge of the ruler and a moveable member. The combination tool is utilized as a marking tool for producing parallel lines and the distance between can be definitively measured upon the scale of the ruler.

The Vane U.S. Pat. No. 2,309,809 is directed to a geometrical instrument having a ruler beam with first and second riders mounted on the beam. The Hart U.S. Pat. No. 2,645,022 is directed to a trammel and beam instrument having two moveable trammel heads mounted on the beam.

The Asperger U.S. Pat. No. 2,824,377 is directed to a geometrical instrument. It has a blade and two trammel heads each having an indicator leg extending from their bottom end. It may also have a scribe attached in one of the trammel heads.

It is an object of the invention to provide a novel structure that can turn a square head into a trammel.

It is also an object of the invention to provide a novel trammel adaptor that can be easily and quickly mounted on a square head or removed from a square head.

It is another object of the invention to provide a novel trammel for a square head that is economical to manufacture and market.

SUMMARY OF THE INVENTION

The trammel adaptor for a square head has as its basic structure a right angle bracket having a vertical leg and a horizontal leg. The vertical leg has a planar inner surface having a left edge and a right edge. The planar inner surface has a vertically extending co-axial Y-axis. A vertically extending left flange is connected to the left edge of the vertical leg and they intersect each other at an acute angle A. A vertically extending right flange is connected to the right edge of the vertical leg and they intersect each other at an acute angle B. The left and right flanges along with the planar inner surface of the vertical leg form a track for removably receiving the rear vertical flanges of a square head.

The horizontal leg of the right angle bracket has a planar top surface, a left edge and a right edge. A horizontally extending left flange is connected to the left edge of the horizontal leg and they intersect each other at an acute angle C. A horizontally extending right flange is connected to the right edge of the horizontal leg and they intersect each other at an acute angle D. The top surface of the horizontal leg abuts against the bottom end of the square head when the right angle bracket is telescopically slid onto the rear vertical flanges of the square head.

A tubular boss member is connected to the bottom end of the right angle bracket and it provides a support for an indicator leg having a bottom end point.

DESCRIPTION OF THE PREFERRED EMBODIMENT

Figure 1:
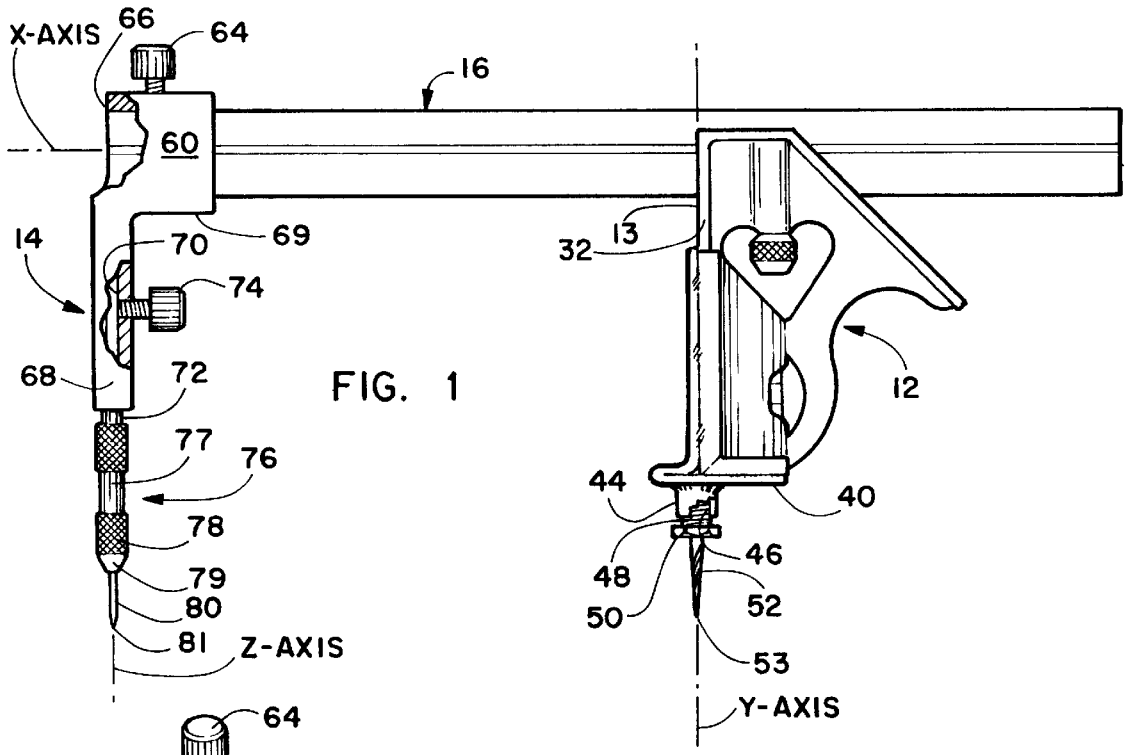
FIG. 1 is a side elevation view illustrating the trammel adaptor detachably secured to the bottom end of the square head and the square head is detachably secured on a rule that also has a trammel detachably secured thereon.
Figure 2:
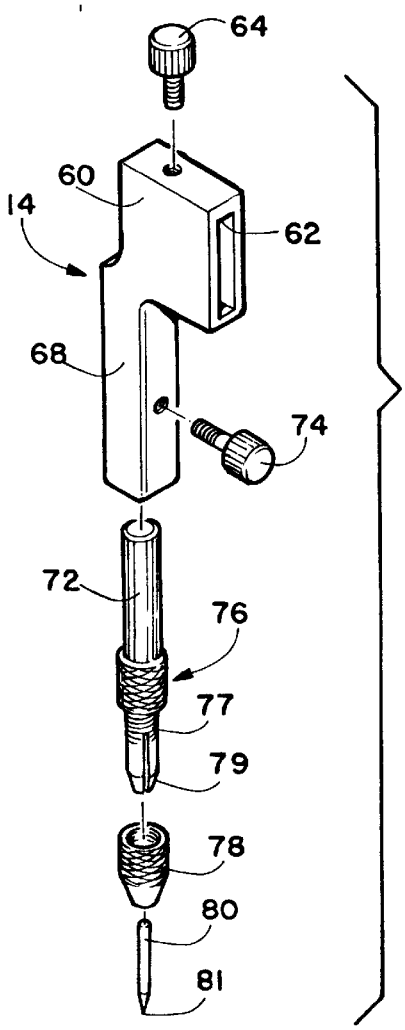
FIG. 2 is an exploded front perspective view of the trammel.
Figure 3:
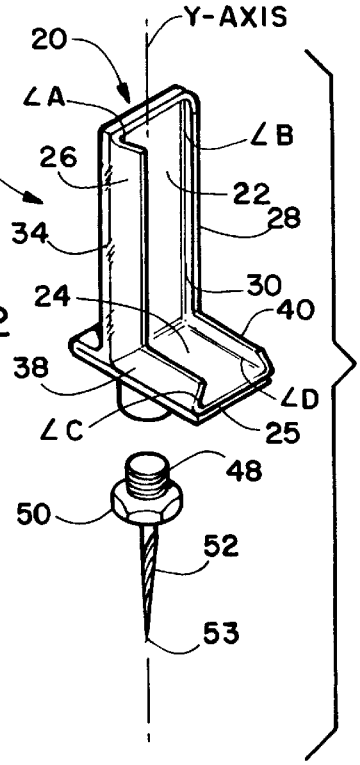
FIG. 3 is an exploded front perspective of the trammel adaptor.

The novel trammel adaptor 10 will now be described by referring to FIGS. 1–3 of the drawing. It is detachably secured to a square head 12. Square head 12 and trammel 14 are detachably secured on rule 16.

The basic structure of trammel adaptor 10 is a right angle bracket 20 having a vertical leg 22 and a horizontal leg 24. Vertical leg 22 has a planar inner surface and a Y-axis extends vertically along this surface. A left flange 26 is connected to the left edge of vertical leg 22 and they intersect each other at an acute angle A. A right flange 28 is connected to the right edge of vertical leg 22 and they intersect each other an acute angle B. Flanges 26 and 28 and the inner surface of upright leg 22 form a track 30 for receiving a pair of flanges 32 on square head 12. A plate 34 is spot welded to the outer surface of vertical leg 22 to give it added strength.

Horizontal leg 24 has a bottom surface 25. A left flange 38 is connected to the left edge of horizontal leg 24 and they intersect each other at an acute angle C. A right flange 40 is connected to the right edge of horizontal leg 24 and they intersect each other at an acute angle D. A plate 40 is spot welded to the bottom surface of horizontal leg 24 to give it added strength. A tubular boss member 44 is secured to the bottom surface of plate 40. It has a threaded bore 46. Externally threaded member 48 is threaded into bore 46. An annular flange 50 is formed on member 48 adjacent its bottom end. An indicator leg 52 extends downwardly from the bottom end of flange 50 and it has a point 53 on its bottom end.

Rule 16 has a longitudinally extending X-axis. Square head 12 makes a 90 degree angle with rule 16 and the rear end 13 of square head 12 aligns with the Y-axis.

Trammel 14 has a head portion 60 having a slot 62 that receives rule 16. A set screw 64 locks it into position. The front edge 66 of head portion 60 lies along the vertical Z-axis. A leg portion 68 extends downwardly from the bottom surface 69 of head portion 60. It has a bore 70 that receives a shank 72 that is locked in position by set screw 74. Shank 72 is a part of point support 76 that includes a sleeve 77, a collar 78, jaws 79, and an indicator leg 80 having a point 81.

What is claimed is:

1. A trammel adaptor for a square head comprising:

a right angle bracket having a vertical leg and a horizontal leg;

said vertical leg having a planar inner surface, an outer surface, a left edge, a right edge, a top end and a bottom end; said planar inner surface having a vertically extending co-axial Y-axis; a vertically extending left flange is connected to said left edge of said vertical leg and they intersect each other at an acute angle A; a vertically extending right flange is connected to said right edge of said vertical leg and they intersect each other at an acute angle B; said left and right flanges form a track for removably receiving the rear vertical flanges of a square head;

an elongated indicator leg having a top end and a pointed bottom end and having a longitudinal axis that coincides with said Y-axis; and means for detachably securing said top end of said indicator leg to said bottom end of said vertical leg of said right angle bracket.

2. A trammel adaptor for a square head as recited in claim 1 wherein said horizontal leg of said right angle bracket has a planar top surface, a left edge, and a right edge; a horizontally extending left flange is connected to said left edge of said horizontal leg and they intersect each other at an acute angle C; a horizontally extending right flange is connected to said right edge of said horizontal leg and they intersect each other at an acute angle D.

3. A trammel adaptor for a square head as recited in claim 1 further comprising a vertical plate secured to said outer surface of said vertical leg of said right angle bracket.

4. A trammel adaptor for a square head as recited in claim 1 wherein said means for detachably securing said top end of said indicator leg to said bottom end of said vertical leg of said right angle bracket comprises means for adjusting the height of said pointed bottom end of said indicator leg.

5. A trammel adaptor for a square head head as recited in claim 1 in combination with a square head.

6. A trammel adaptor for a square head as recited in claim 5 further comprising a vertically oriented horizontally extending elongated rule having a left end and a right end and said square head is detachably secured thereon.

7. A trammel adaptor for a square head as recited in claim 6 further comprising:

a trammel detachably secured to said rule adjacent said left end; said trammel having a head portion having a bottom surface and also a slot for receiving said rule; said head portion having a front edge through which passes a vertically oriented Z-axis; a vertically oriented leg portion extends downwardly from said bottom surface of said head portion;

an elongated indicator leg having a top end and a pointed bottom end and having a longitudinal axis that coincides with said Z-axis;

means for detachably securing said top end of said indicator leg to said bottom end of said vertically oriented leg portion.

* * * * *